United States Patent [19]

Garland

[11] Patent Number: 4,763,580

[45] Date of Patent: Aug. 16, 1988

[54] SUPPORTING

[76] Inventor: Thomas A. Garland, 76 Reservoir Cir., Jamestown, R.I. 02835

[21] Appl. No.: 947,049

[22] Filed: Dec. 29, 1986

[51] Int. Cl.[4] ..... A47C 13/00; A47B 7/00

[52] U.S. Cl. ..... 108/91; 297/1; 297/3; 312/265

[58] Field of Search ..... 297/1, 3, 130, 192; 182/178; 312/265; 211/126; 280/87.01; 108/91

[56] References Cited

U.S. PATENT DOCUMENTS

| | | | |
|---|---|---|---|
| 177,855 | 5/1876 | Leamond | 297/1 X |
| 2,186,188 | 1/1940 | Allen | 280/87.01 X |
| 2,776,700 | 1/1957 | Potter et al. | 297/3 |
| 3,334,942 | 8/1967 | Breslow | 297/1 |
| 3,848,700 | 11/1974 | Davis, Jr. | 182/181 |
| 3,879,083 | 4/1975 | Olsson | 297/1 |
| 4,205,876 | 6/1980 | Cetina | 297/3 X |
| 4,433,753 | 2/1984 | Watson | 182/178 X |
| 4,563,040 | 1/1986 | Alster | 312/265 X |

FOREIGN PATENT DOCUMENTS

| | | | |
|---|---|---|---|
| 871903 | 7/1961 | United Kingdom | 108/91 |

*Primary Examiner*—James T. McCall
*Attorney, Agent, or Firm*—Charles Hieken

[57] ABSTRACT

A support structure that may be used as a seat, table or step stool has a top panel substantially 10"×18" secured between two angled panels substantially 10" above the floor. A pair of normally vertical support members extend between the end panels in contact with the bottom of the top panel and are each formed with a groove that accommodates a tension rod fastened between the end panels. A handle opening is formed near the top of each end panel. The end panels are formed with legs that project beyond the projection of the top panel as seen from the top, both longitudinally and transversely.

24 Claims, 14 Drawing Sheets

Fig. 4A
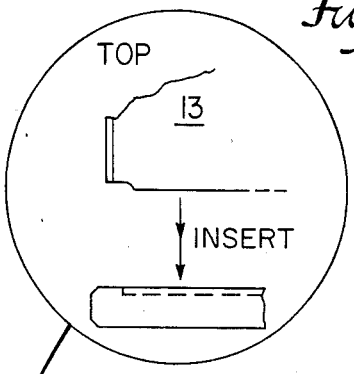
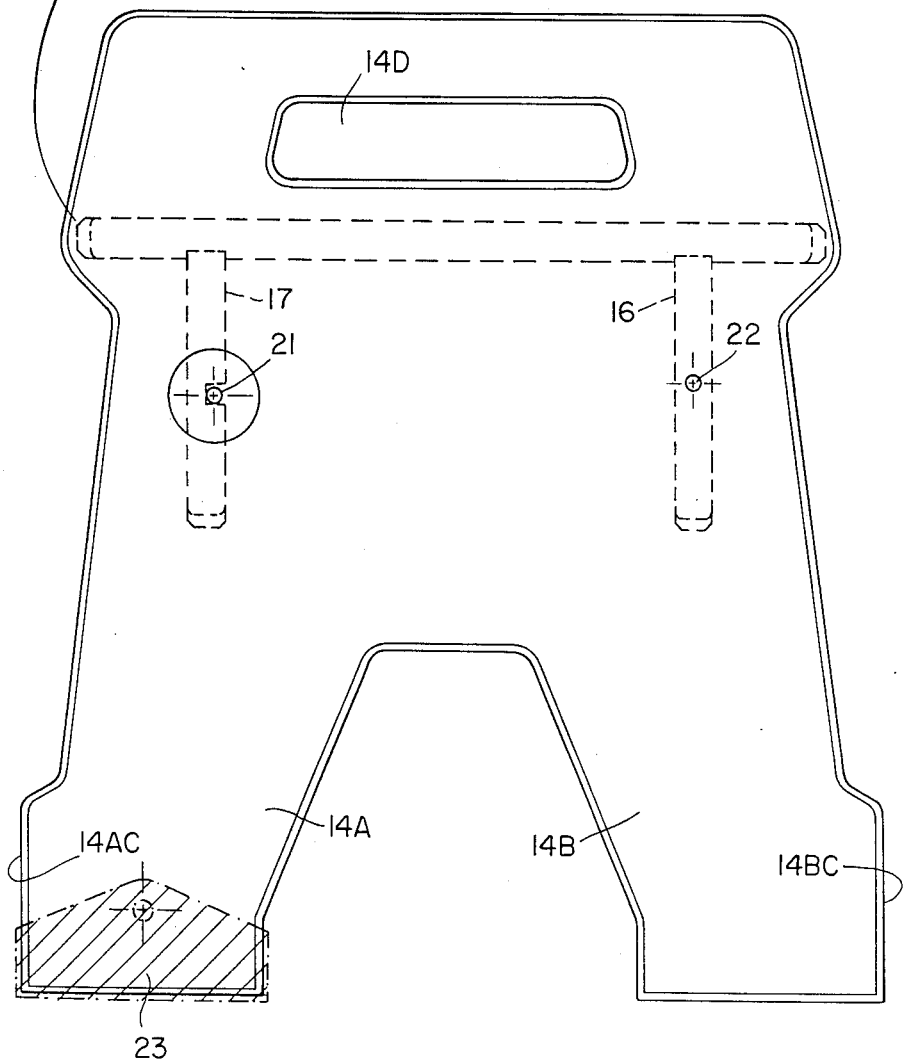
Fig. 4

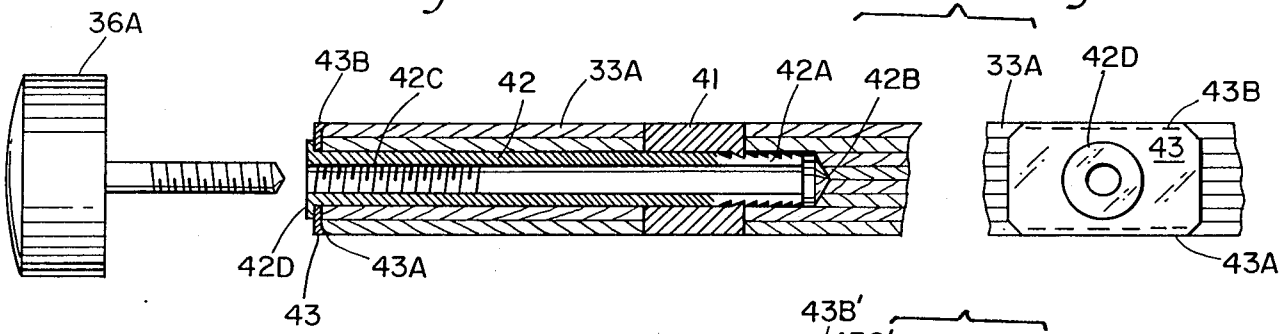
Fig. 11
Fig. 12
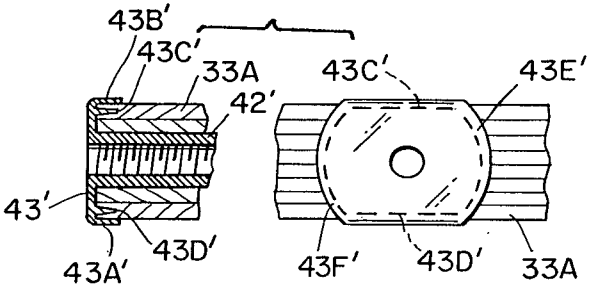
Fig. 13
Fig. 14

SUPPORTING

The present invention relates in general to supporting and more particularly concerns a novel structure that may be used by children and adults as a seat, step and table, for example, while being exceptionally stable, sturdy, safe, and convenient to carry and store.

It is an important object of the invention to provide an improved support structure.

According to the invention, the novel support structure includes a top panel secured between a pair of end panels. Each end panel defines support legs at the bottom extending outside the projection of the top panel upon the horizontal plane. Preferably, the end panels are formed with handle openings at the top and legs each having a bottom portion extending outward for a height slightly less than the normal height of the kick panel region along a room floor to allow the structure to extend into the kick space beneath kitchen cabinets. Preferably, there are normally vertical support panels contacting the top panel and extending between the end panels. Preferably, these support panels embrace tension means fastened to the end panels for urging the end panels against the support panels and the top panel.

Numerous other features, objects and advantages of the invention will become apparent from the following specification when read in connection with the accompanying drawing in which:

FIG. 4 is an end view of an embodiment of the invention;

FIG. 4A is a fragmentary view showing details of the rounded edges and indicating plastic laminate location;

FIG. 11 is a fragmentary exploded view partially in section of a preferred fastening means;

FIG. 12 is a front view of the stud receiver of FIG. 11;

FIG. 13 is a fragmentary view of an alternate stud receiver;

FIG. 14 is a front view of the receiver of FIG. 13;

Figure 1:
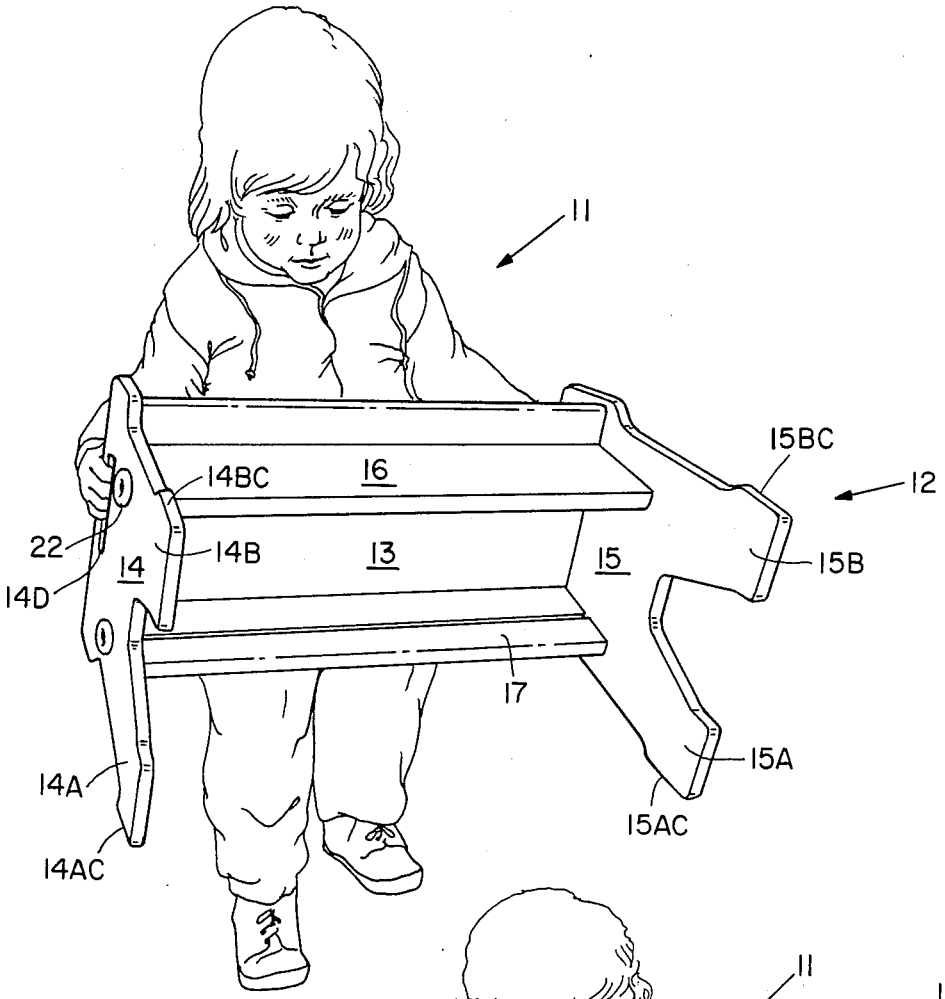
FIG. 1 is a perspective view of a child carrying an embodiment of the invention.

With the reference now to the drawing and more particularly FIG. 1 thereof, there is shown a perspective view of a child 11 carrying a support structure 12 according to the invention. The invention includes a top panel 13 secured between end panels 14 and 15 and abutting normally vertical support panels 16 and 17 each embracing a tension rod, such as 21 and 22, extending between end panels 14 and 15. End panels 14 and 15 are formed with legs 14A and 14B and 15A and 15B. Each of these legs is formed with respective protruding portions 14AC, 14BC, 15AC and 15BC of height, approximately 3", being slightly less than that of a typical room baseboard to allow these projections to fit in the kick space beneath cabinets when the leg portions 14A, 14B, 15A and 15B rest on a floor adjacent to the cabinet. End panels 14 and 15 are inclined at a slight angle to the vertical so that legs 14A, 14B, 15A and 15B extend outside the projection of top panel 13 in the horizontal plane when this panel is normally horizontal. The distance spanned by the extremeties of legs 14A and 14B and that spanned by the extremeties of legs 15A and 15B is sufficiently great so that these extremeties extend outside the projection in the horizontal plane of top panel 13. Stated in other words, the support structure 12 includes a normally horizontal top panel 13 having a pair of opposed long edges extending along its length and a pair of opposed narrow edges extending along its width. End panels 14 and 15 are secured to respective ones of the narrow edges and separated by the top panel long edges normally forming a small angle with the vertical. The end panels 14 and 15 are formed with leg portions 14A and 14B and 15A and 15B extending outside the horizontal projection of top panel 13 so that the separation between leg portions 14A and 14B of end panel 14 and leg portions 15A and 15B of end panel 15 is greater than the length of top panel 13. Normally vertical support panels or members 14 and 15 near the long edges of top panel 13 are in contact with the underside of top panel 13 and are formed with angled ends which angled ends abut end panels 14 and 15.

End panels 14 and 15 are formed with handle openings 14D and 15D normally above top panel 13, respectively, at the top to facilitate easy transport of the invention by an adult or child and protrudes above the step to help identify the step area.

Figure 2:
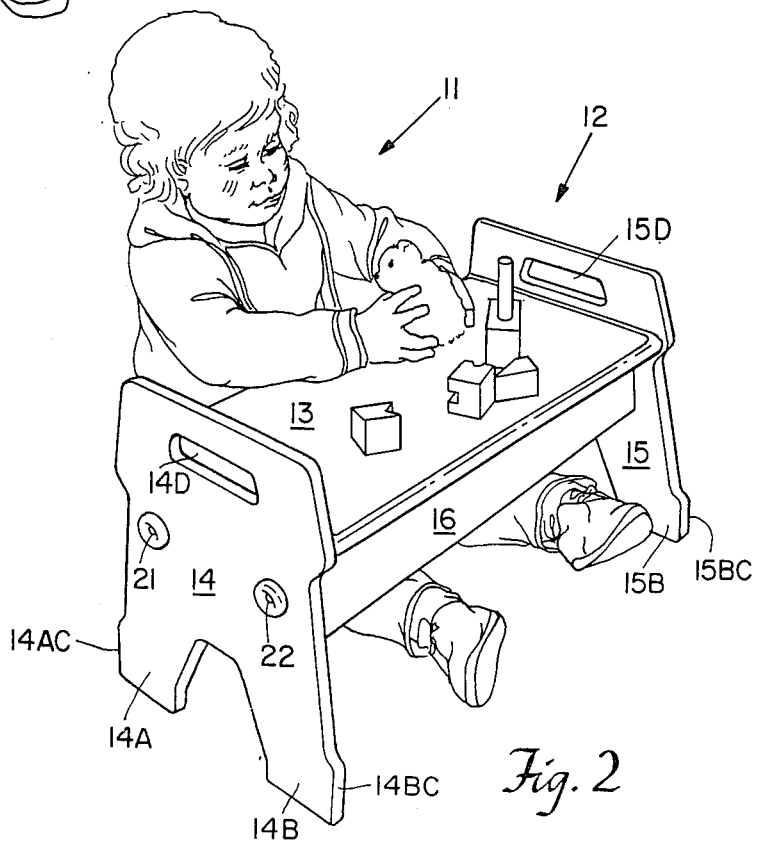
FIG. 2 is a perspective view of a child using the invention as a table while sitting on the floor with legs extended beneath the top and support panels.

Referring to FIG. 2, there is shown a perspective view of child 11 using support structure 12 as a table. The same reference symbols identify corresponding elements throughout the drawing.

Figure 3:
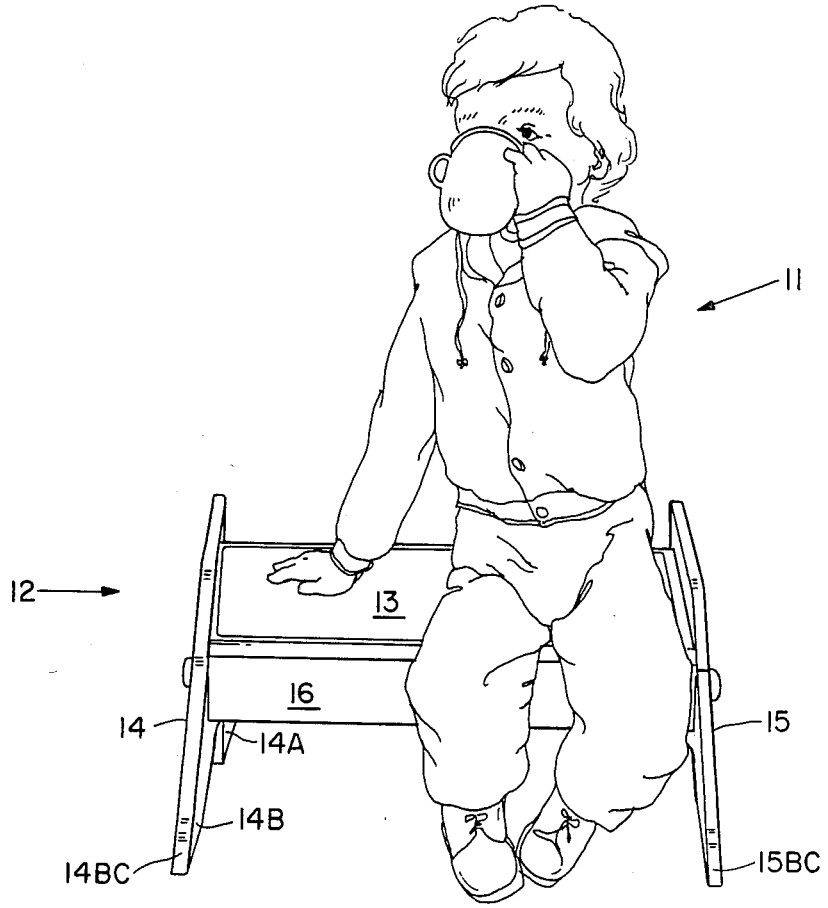
FIG. 3 is a perspective view of a child sitting on the invention.

Referring to FIG. 3, there is shown a perspective view of child 11 sitting on support structure 12.

Referring to FIG. 4, there is shown an end view of the invention with specific dimensions indicated of an actual embodiment of the invention. These dimensions are especially convenient for use by a child in the manner illustrated in FIGS. 1–3 while still being useful as a step stool or a seat for an adult. It may be desirable to fasten boots, such as 23 shown on the bottom of leg 14A, of plastic material for protecting floors while allowing sliding when desired and helping to prevent undesired slipping. The boots will also accent the human form generally represented by the overall shape and proportions of end panels 14,15. While only end panel 14 is visible in FIG. 4, panel 15 is essentially identical to end panel 14.

Referring to FIG. 4A, there is shown a fragmentary view of panels, such as top panel 13 and end panel 14, illustrating how panel 14 is formed with a recess, such as 14E, to receive top panel 13 which has been notched, such as 13A, for efficient manufacture of a blind or hidden joint. FIG. 4A also shows typical chamfered or rounded edges as seen on all exposed edges and visible on end panel 14 in FIG. 4A.

Figure 5:
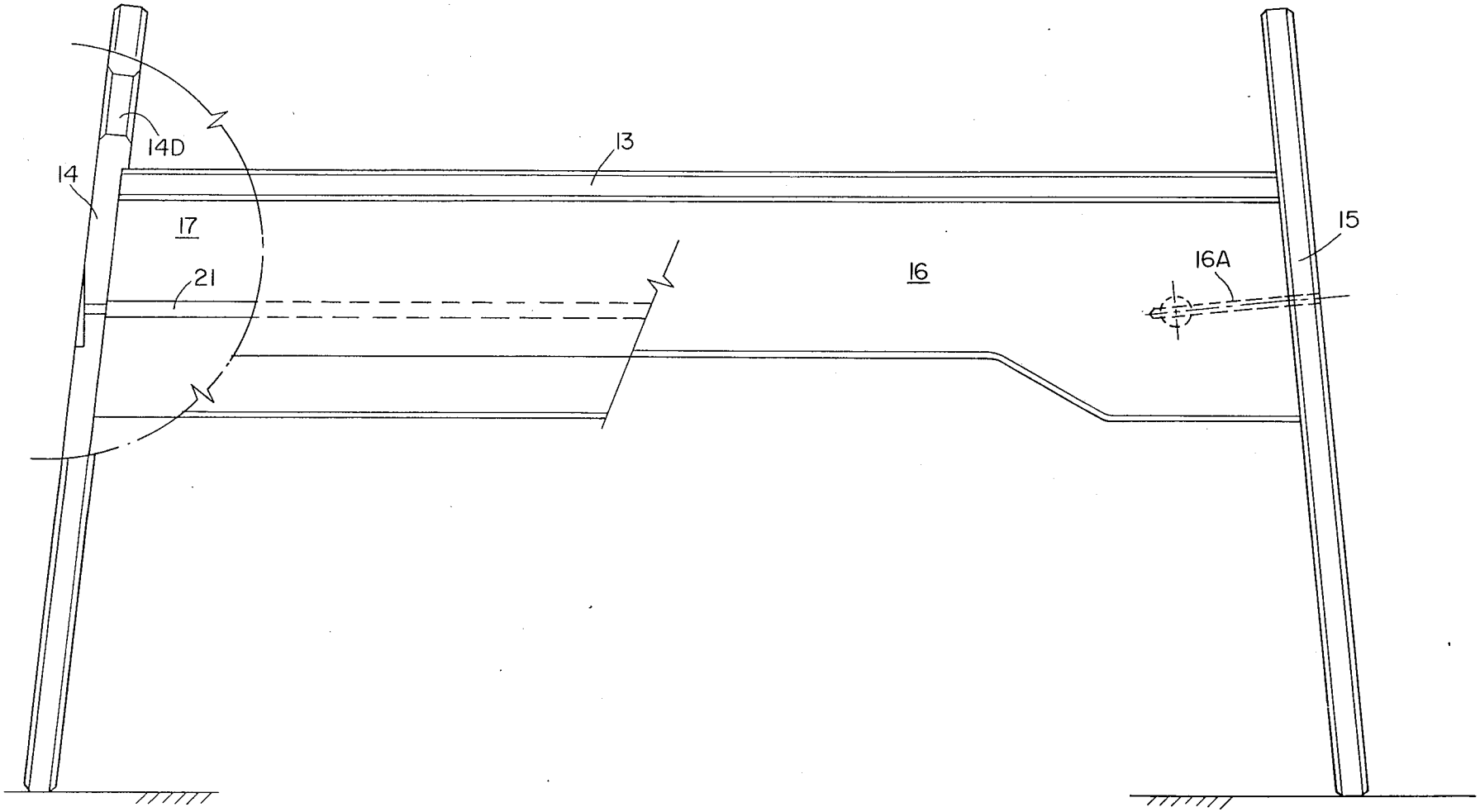
FIG. 5 is a front view of an embodiment of the invention.

Referring to FIG. 5, there is shown a front view of the embodiment of the invention that illustrates how the bottom ends of panels 14 and 15 are completely outside the horizontal projection of top panel 13. This view also shows preferred dimensions. Portions are cut away inside the semicircle at the left to illustrate certain structural details. This view shows how the ends of top panel 13 and support panels 16 and 17 slope to provide flush contact with end panels 14 and 15 at the 5.71° angle of inclination with the vertical as shown. The overall dimensions of top panel 13 are substantially 18" long, 10" wide and substantially 10" high. The separation between the lower ends of end panels 14 and 15 is substantially 20". The invention is thus characterized by good stability resulting in part from the angled ends and feet extending beyond the edge of top panel 13, the separation and location of handle openings 14D and 15D, the protrusion of the handles above top panel 13 to act as stops. In one form the invention is made of wood, typically using high quality "Baltic Birch" or equivalent plywood with colorful, durable, high pressure laminate faces. The invention also may be made of plastic to reduce costs and facilitate sterilization to allow use in hospitals, laboratories and for other similar applications.

As an alternative to using full-length tension rods between end panels 14 and 15, it may be desirable to use toggle bolts, or conventional screws, extending partway into vertical support members 16 and 17, such as 16A as shown in FIG. 5.

Preferably all exposed faces are plastic laminates. Edges are preferably finished with a 45° bevel, or rounded edge, each side and a flat between to enhance the safety of all surfaces on impact and to reduce end damage. Preferably no paint is used to avoid ingestion by children. All surfaces are easy to clean. Preferably, the edges are coated with polyurethane or epoxy clear finish. The plastic laminate may be bonded to the plywood on a high speed press and then processed on a multiheaded, multitooled, numerically controlled router with a vacuum table, thereby providing a cost efficient, composite structural member offering high wear resistance, good color conformity and utility. The shape and inclined angle of end panels 13 and 14 minimize the danger to a user, whether child or adult, as a result of use or misuse. In a specific embodiment of the invention, a child or adult can stand on the top of the handle area or end panel without tipping the structure.

All surfaces of the top panel 13 are inside the outermost projection of legs 14A, 14B, 15A and 15B, both longitudinally and transversely as seen from above so that the structure is inherently stable, regardless of foot placement. Separation of feet on the individual end panels 14 and 15 has been sized and shaped to prevent jambing of body parts in the slot formed between legs. The handles comprising handle openings 14D and 14D have been sized and placed and laterally spaced (left-right separation) to allow comfortable lifting and movement by children as young as twelve months through adults.

It has been discovered that children often enjoy pushing or pulling the structure around by one handle, and that the structure is stable under such use. As best seen in FIG. 4, the outer vertical edge of feet 14A, 14B, 15A and 15B projects about $\frac{7}{8}$" beyond the outer extend of top panel 13 as seen from the top. Above 3" above floor height, each leg is cut away to allow the lower feet protrusions 14AC, 14BC, 15AC and 15BC to slide under a cabinet and project into the kick space. Typically, the lowermost edge of a cabinet face is 4" above the floor. Top panel 13 may then be moved closer to the cabinet face, preventing a child from stepping off the edge between cabinet and top panel 13 while still providing stability from a leg projection.

Preferably, surfaces are smooth finished for easy cleaning. Top panel 13 is preferably covered with a nonskid, high pressure laminate surface requiring no further processing. This surface is not abrasive and will not result in skin abrasions, but rather provides moderate nonslip characteristics consistent with the nonslip characteristics of feet. It has been discovered that both the bench feet and the top panel should offer some ability to slid so that a child can feel a gradual loss of stability and make corrections in body placement rather than be surprised by a sudden fall from an overextended body position and overly nonslip surface.

The overall structural configuration of two angled end panels separated by a top panel that functions as a step, seat or tabletop and a pair of stiffeners near the outer edges of the top panel results in maximizing strength and stiffness in response to loading on the top panel while minimizing racking and distortion along the long axis of the top panel as a result of abuse.

The structure is also stackable on like structures and may include indexing guides to stabilize a stack of structures with the existing parts, or by installing a male/-female slot and slide hardware item on each end to allow more stable stacking.

The structure may be used as a stool to allow children and adults to reach greater heights. For example, a child may reach a counter or sink. An adult may use the structure to reach top shelves in a cabinet or closet. A child may use the structure as a table with legs extended under vertical supports 16 and 17 and top panel 13 as shown in FIG. 2. A child may sit on the structure as a seat as shown in FIG. 3. Two children, or an adult and a child, may sit side-by-side. The preferred top panel length of 18" is sufficient to allow an adult and small child to sit together.

The preferred width of the top panel at 10" provides good foot room for an adult and ample flat area for children to use top panel 13 as a workbench/play area. Further, the 18" length is sufficient to allow an adult to have proper foot separation for good stability when reaching or lifting. The top panel height at 10" is a standard step height and also provides a good height for younger children to reach counters while still being able to climb upon top panel 13. Children up to three-four years old find the top panel height comfortable as a table and work platform from a standing position.

Additionally, the structure is suitable for a carpenter's helper bench and work platform for cutting and clamping wood and making general repairs. The structure may be used by a craftsman as a seat for good stability in awkward positions. The structure facilitates determining handle locations and extent of top panel area through feel so that the eyes need not leave the work area, thereby promoting safety. The structure may also be pushed or kicked across the floor and moved about with only one hand.

The structure may be formed with a removable or hinged panel or panels in the top panel area to expose a storage tray extending between vertical support panels 16 and 17.

Figure 6:
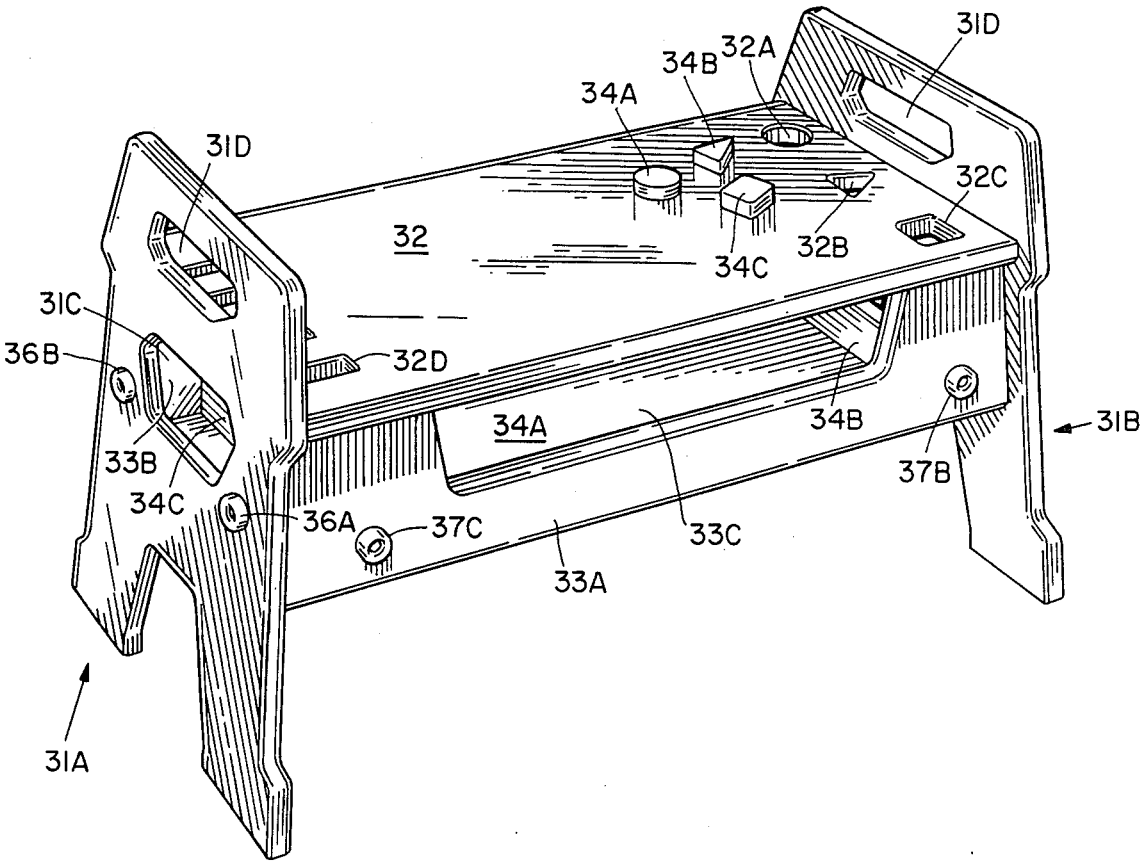
FIG. 6 is a perspective view of another embodiment of the invention.

Referring to FIG. 6, there is shown an alterate embodiment of the invention incorporating a number of the features of the embodiment of FIGS. 1–5 while introducing additional features. This embodiment includes end panels 31A and 31B, each having a compartment opening, such as 31C and a handle opening, such as 31D. A top panel 32 rests on side panels 33A and 33B, each formed with an opening such as 33C for providing access to the compartment below top 32 having a bottom panel 34A and end dividers 34B and 34C that divide the compartment into a large intermediate compartment accessible through openings such as 33C, and smaller end compartments accessible through openings such as 31C. Dividers 34B and 34C may only partially divide small from large compartments, thereby allowing access to all compartments from openings 31C and 33C.

Top 32 may be formed with circular, triangular square, or other geometrically shaped, such as openings 32A, 32B and 32C, respectively, at one end for passing round, triangular and square chips 34A, 34B and 34C, respectively, and rectangular slots, such as 32D at the other end for passing the chips on edge into an end compartment below.

Preferably, the assembly is held together by means including hand screws, such as 36A and 36B that fasten end panel 31A to side panels 33A and 33B, respectively, and hand screws 37B and 37C that fasten end dividers 34B and 34C, respectively, to side panel 33A.

Figure 7:
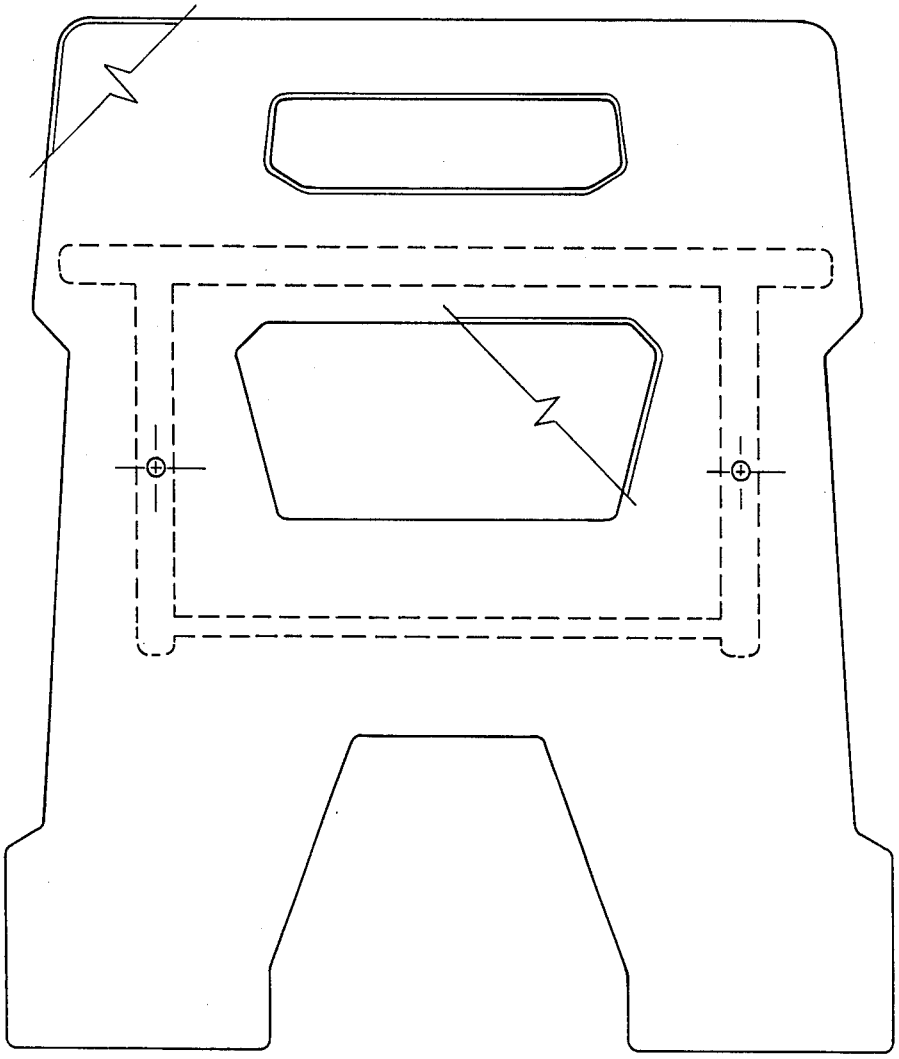
FIG. 7 is an end view of the embodiment of FIG. 6.

Referring to FIG. 7, there is shown an end view of the embodiment of FIG. 6 with hand screws omitted.

Figure 8:
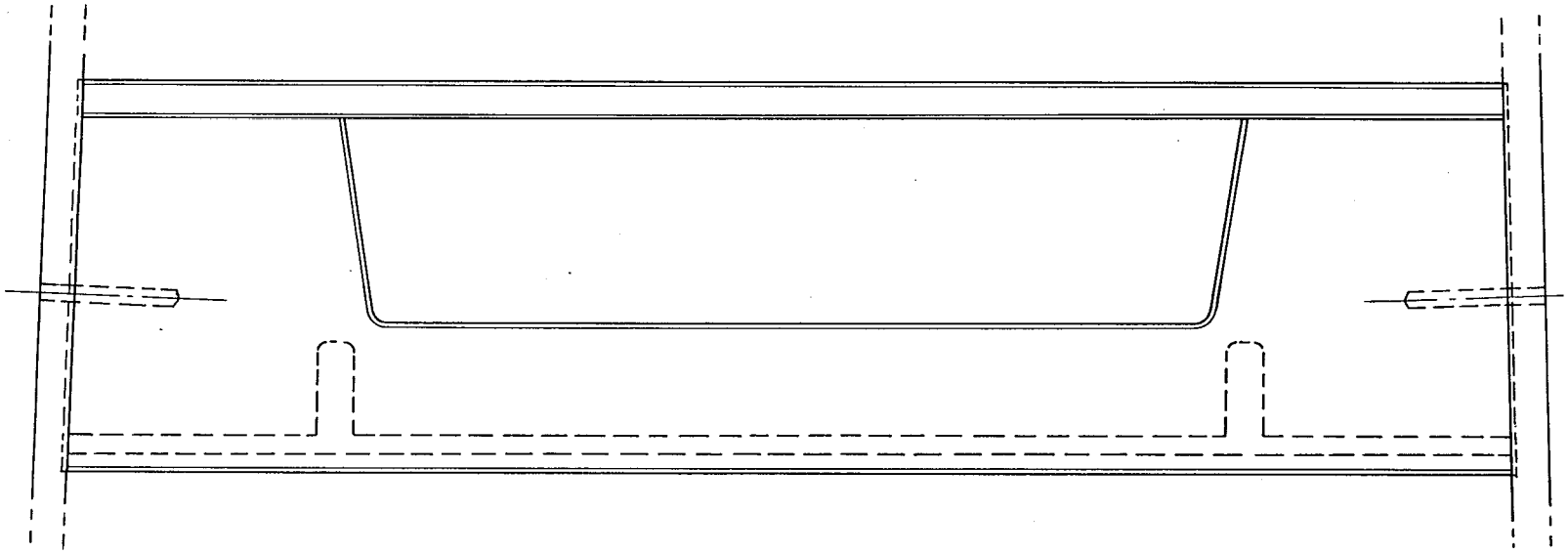
FIG. 8 is a fragmentary front view of the embodiment of FIG. 6.

Referring to FIG. 8, there is shown a partial side elevation view of the embodiment of FIG. 6 with hand screws omitted.

Figure 9:
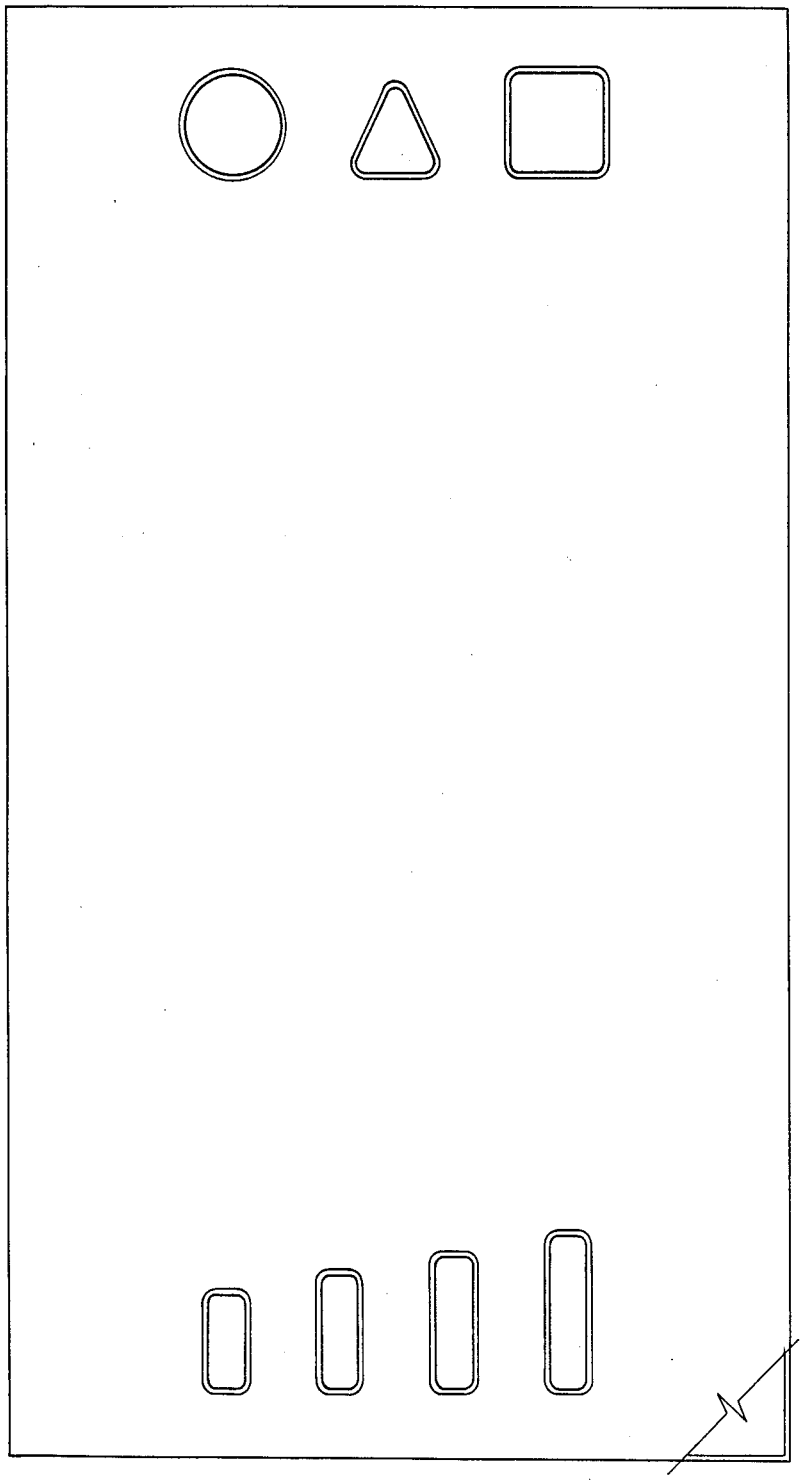
FIG. 9 is a plan view of the top of the embodiment of FIG. 6.

Referring to FIG. 9, there is shown a plan view of top 32.

Figure 10:
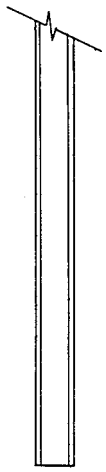
FIG. 10 is a fragmentary side elevation view of the top of FIG. 9.

Referring to FIG. 10, there is shown a fragmentary side elevation view of top 32.

Referring to FIG. 11, there is shown a fragmentary partially exploded sectional view illustrating how a hand screw is received in a side panel or divider. A side panel, such as 33A, is drilled with a transverse opening that accommodates metal plug 41 having a central opening coaxial with a lengthwise hole drilled in the side panel that accommodates hollow sleeve 42 that passes through member 41 and is formed with serrations 42A pointed as shown to allow entry while resisting removal as member 42 is driven into the opening led by pointed end 42B. Alternatively, serrations 42A may be replaced with a threaded end, allowing member 42 to be threaded into member 41. A conventional expansion type end may also be used, allowing the end of member 42 to be locked into place by expanding the tip of member 42 upon positioning post member 41. Sleeve 42 is internally threaded at the input end 42C and formed with an annular lip 42D that engages a generally rectangular washer 43 formed with inwardly extending clamping edges directed inward for keeping the plies of the plywood forming a panel together as sleeve 41 is forced into the bore, the bore often being drilled with an inside diameter slightly less than the outside diameter of sleeve 42. Hand screw 36A may then be easily screwed into the internally threaded opening to snugly secure panels together. Referring to FIG. 12, there is shown a plan view of washer 43 and lip 42D over side panel 33A.

Referring to FIG. 13, there is shown a fragmentary sectional view of an alternate arrangement in which the sleeve and rectangular washer are formed as a unitary structure with annular lip 42D omitted. Internally threaded sleeve 42' is formed with a transverse stem 43' having bent-over edges 43A' and 43b' for snugly engaging the panel faces and having prongs 43C' and 43D' for penetrating the panel to help prevent rotation of sleeve 42'. The washer and bent over edges or prongs principally function to reduce shear stress levels in the wood or other material into which the fastener is engaged resulting from transverse or non-axial loading. Recognizing that any nonaxial load tends to cause the typical fastener shaft such as member 42 to act as a wedge and lever to split and separate the material in the direction of loading, the washer with prongs or bent edges induces stress into a larger area of surrounding material, thereby reducing force per unit area and likelihood of failure. FIG. 14 is a fragmentary front view of the structure of FIG. 13. The internal knife edge comprising prongs 43C' and 43D' may extend all the way around the include curved knife edges 43E' and 43F'.

Only those fastener configurations which require the rotation of member 42 must have an independent washer. Others may utilize a unitary construction, joining washer to member 42. This embodiment of the invention provides a number of additional advantages. The internal compartments may be used for storage. The openings on the top may be used to promote child coordination. The assembly is held together sturdily, yet may be easily assembled and disassembled by using the hand screws, thus facilitating shipment and assembly, and teaching children assembly and disassembly.

Figure 15:
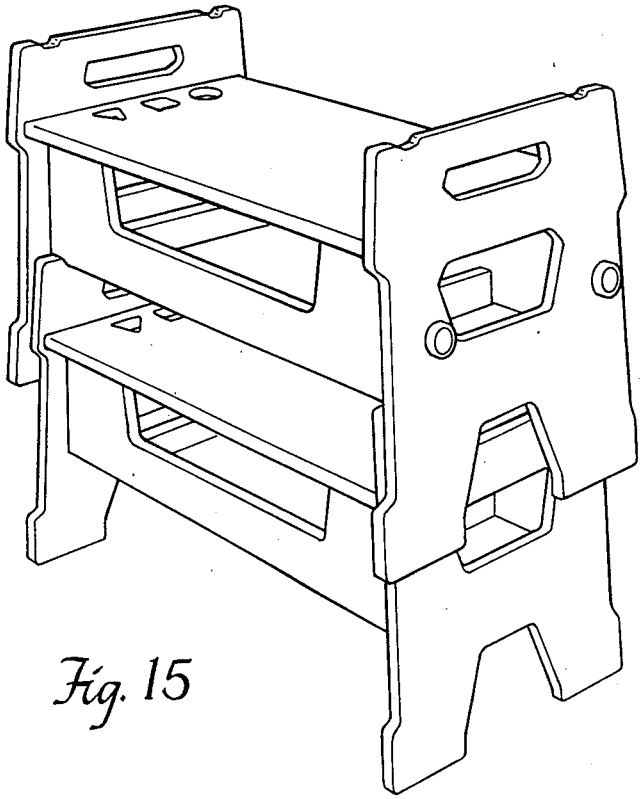
FIG. 15 is a perspective view of one support structure supported on another according to the invention.

Referring to FIG. 15, there is shown a perspective view of an embodiment of the invention showing one support structure stacked on another.

Figure 16:
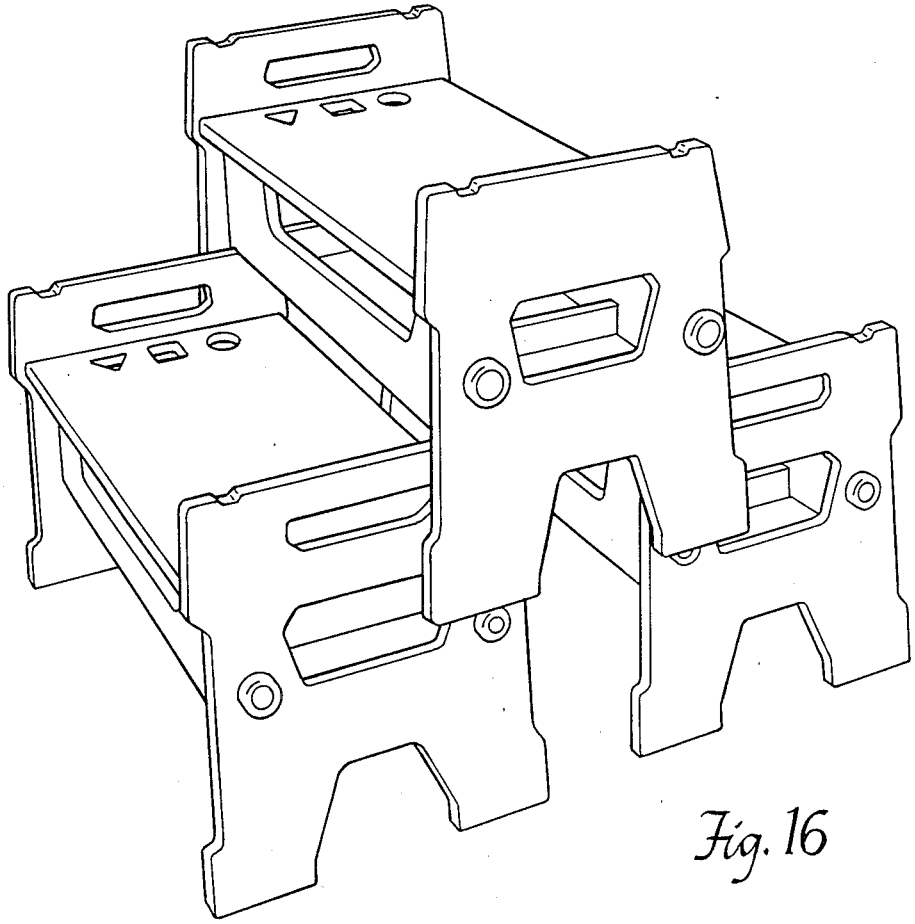
FIG. 16 is a perspective view of one support structure stacked on a pair of side-by-side support structures according to the invention.

Referring to FIG. 16, there is shown a perspective view of another embodiment of the invention showing two support structures side-by-side with a third support structure centered on the space between the first two and supported on the first two structures. The top edges of each end panel are formed with recesses for accommodating a bottom corner of a lengthwise vertical panel.

Figure 17:
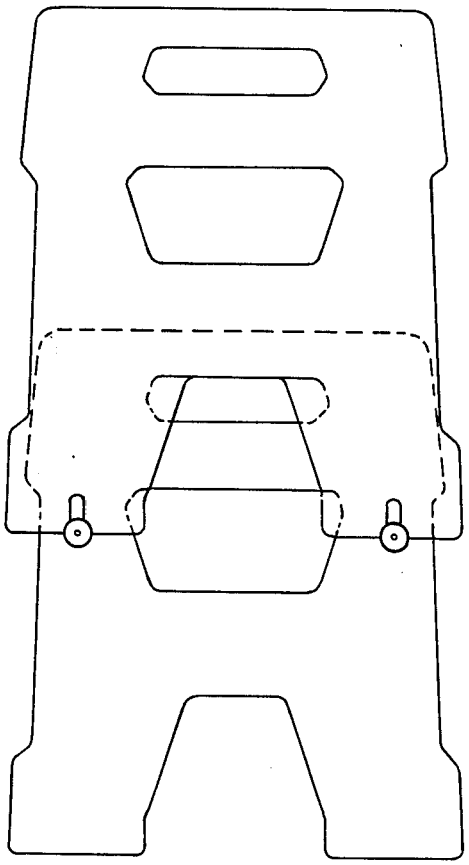
FIG. 17 is an end elevation view of the assembly of FIG. 15.

Referring to FIG. 17, there is shown a supplemental or alternate approach for stacking by forming vertical slots in each depending leg of an end panel that may then rest on a stud in a lower end panel that may comprise a threaded fastener to securely fasten the stacked-together support structures together and prevent tipping.

Figure 18:
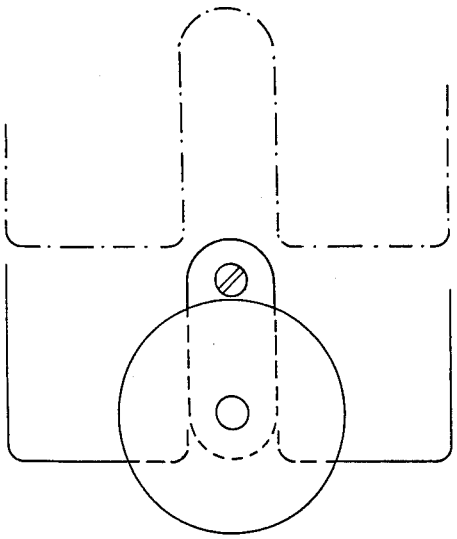
FIG. 18 is a fragmentary view showing how secure stacking may occur.

Referring to FIG. 18, there is shown a detail for effecting this fastening in which a block with rounded ends is fastened to the lower end panel with a permanently attached screw over which the mating notch in the leg of the end panel above resides, the other end being secured to the threaded fastener having a knob on the end.

Figure 19:
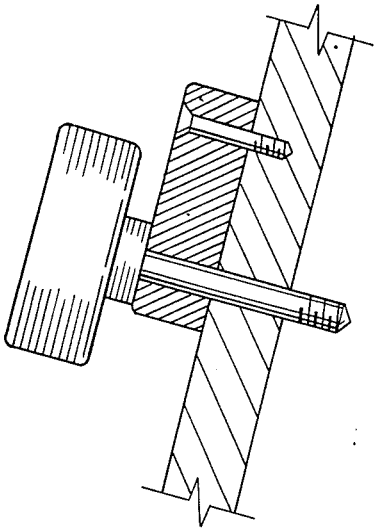
FIG. 19 is a fragmentary view partially in section illustrating how elements may be fastened together.

Referring to FIG. 19 there is shown a fragmentary side view partially in section of structure shown in FIG. 18 illustrating the relationship between the block with rounded ends, the upper screw, the lower threaded fastener with the knob on the end and the end panel portion.

Figure 20:
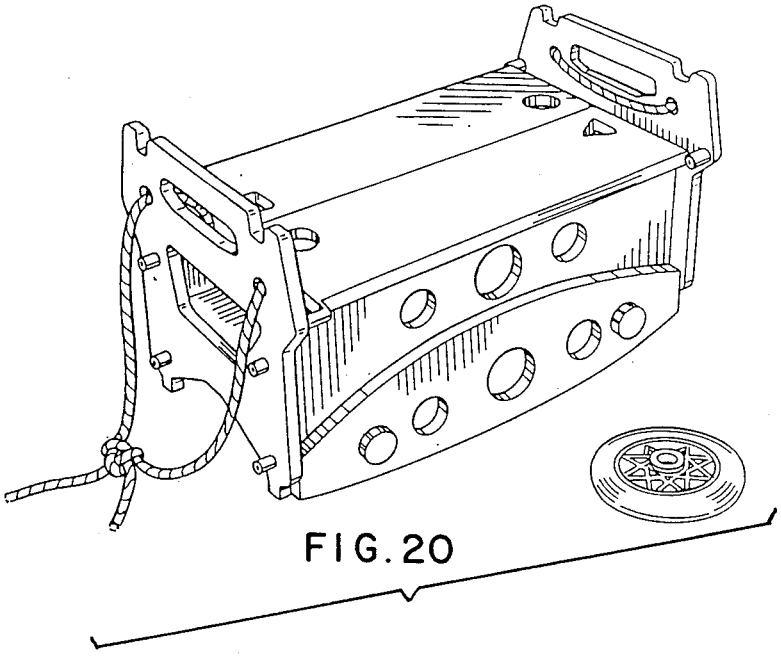
FIG. 20 is a perspective view of another embodiment of the invention having a towing line capable of accommodating wheels, with the top panel split and openable to expose the compartment below, and having lengthwise reversible rocking panels near the bottom.

Referring to FIG. 20, there is shown a perspective view of another embodiment of the invention having tow lines in each end panel and formed with a top panel split along the middle and hinged along each side to form doors covering the storage compartment space below. Reversible rocker panels near the bottom allow rocking over different arcs and may be removed.

Figure 21A:
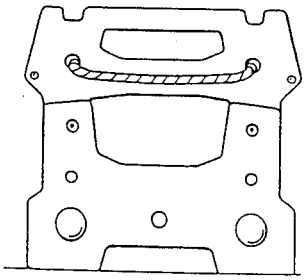
FIGS. 21A, 21B and 21C are end views illustrating how the height of the structure of FIG. 20 may be positioned at three different levels.
Figure 21B:
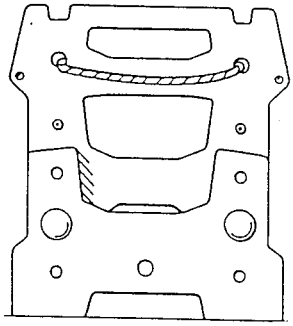
Figure 21C:
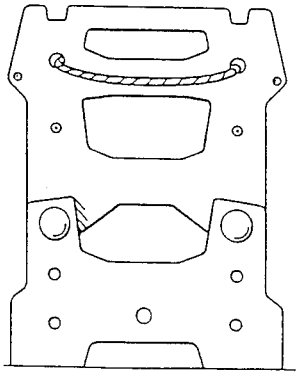

Referring to FIGS. 21A, 21B and 21C, there are shown end views of a portion of the embodiment of FIG. 20 fastened to a lower end panel with knobbed threaded fasteners illustrating how the height may be changed by seating threaded sleeves attached to the upper end panel in different pairs of openings formed in the lower end panel.

Figure 22:
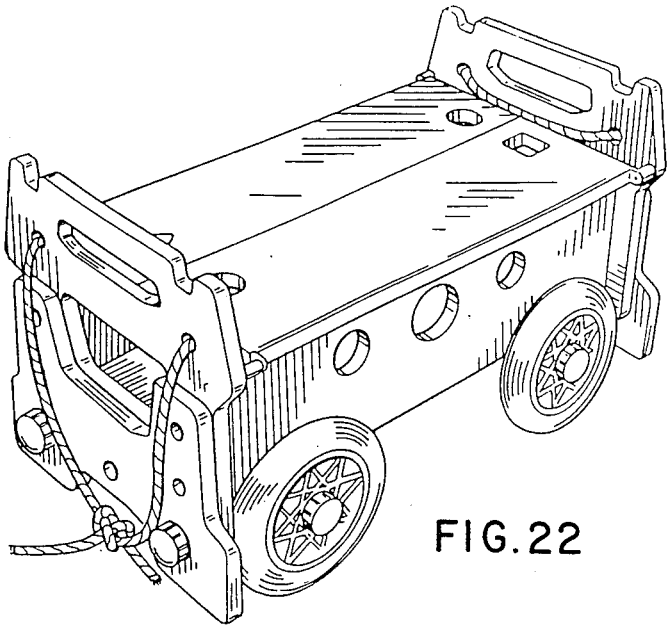
FIG. 22 is a perspective view of the embodiment of FIGS. 20 and 21A with wheels attached.

Referring to FIG. 22, there is shown a perspective view of the embodiment of FIGS. 20 and 21A with wheels attached.

Figure 23:
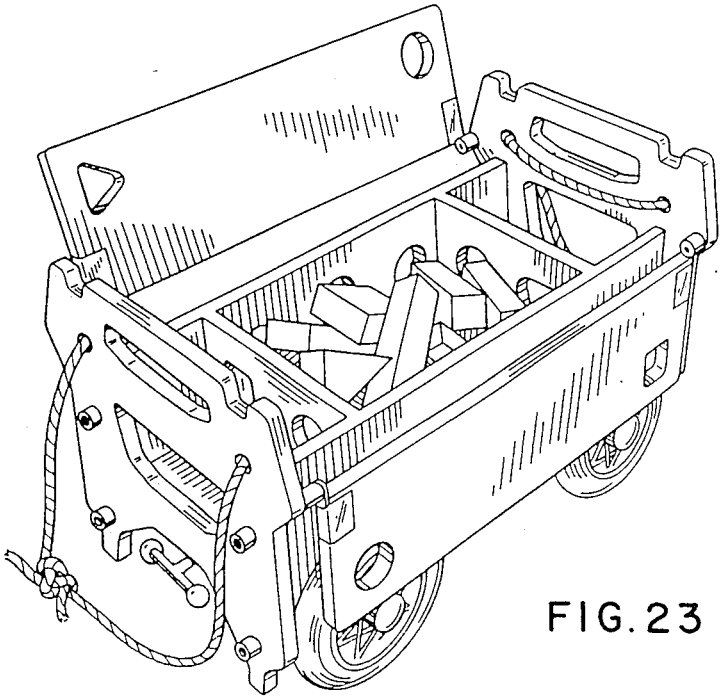
FIG. 23 is a perspective view of the embodiment of FIG. 20 with wheels attached and top panels open.

Referring to FIG. 23, there is shown a perspective view of the embodiment of FIG. 20 with wheels attached and the top panel doors open showing the compartment space below exposed.

Figure 24:
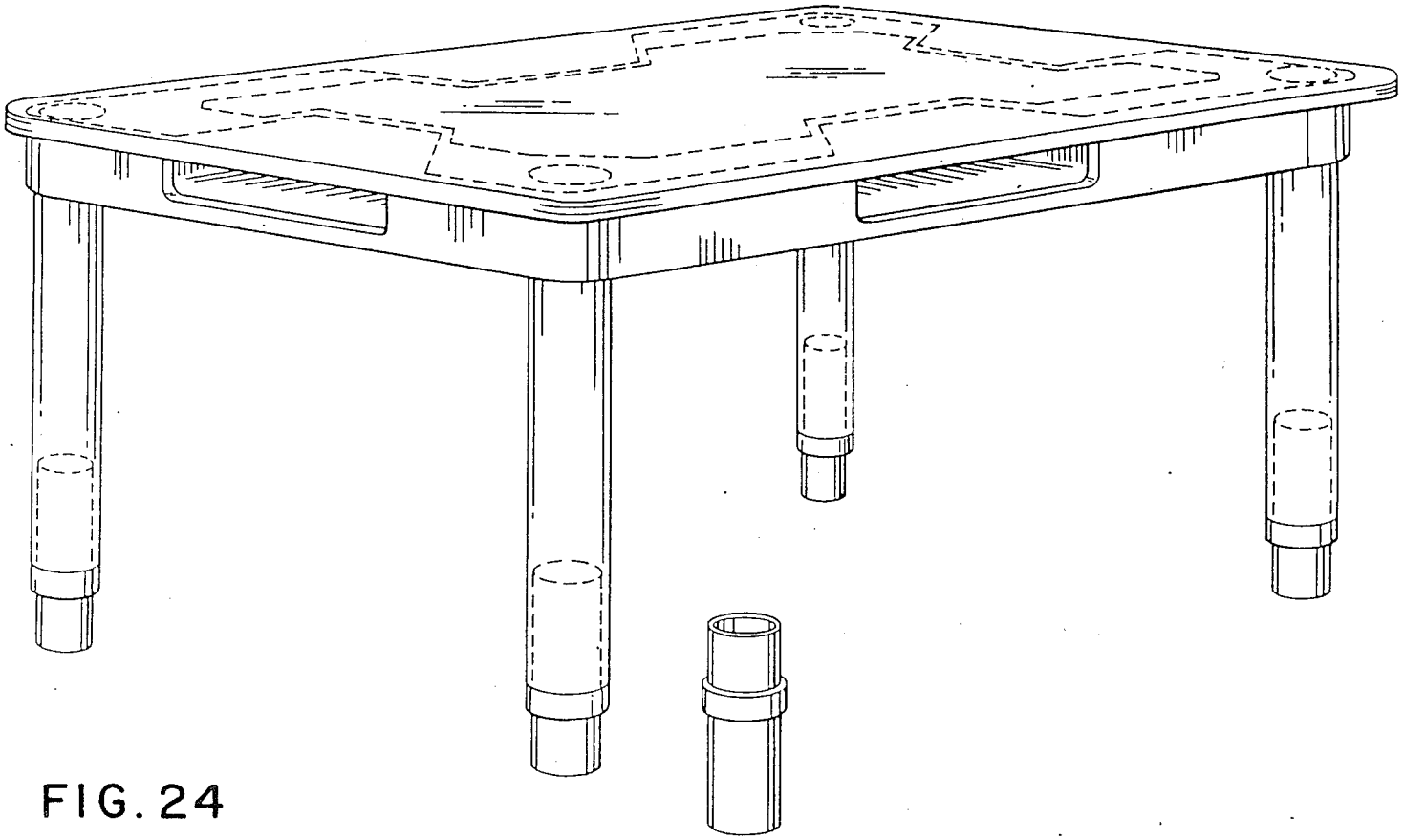
FIG. 24 is a support structure according to the invention in the form of a table.

Referring to FIG. 24, there is shown a perspective view of another support structure according to the invention in the form of a table having hollow legs in which a detachable lower leg portion may be fitted. The detachable lower leg portion is formed with an eccentric annular ring or collar upon which the bottom of the hollow upper leg rests. This structure allows the height of the table to be varied from a lowest height with no inserts, to an intermediate height with the annular collar nearer to the floor as shown in the four legs to a maximum height with the annular collar further away from the floor as indicated by the lower leg portion shown to the side.

The invention may comprise a multi-functional bench and companion table that may be wood or plastic. The table may incorporate legs with feet inserts to allow various working heights and optional storage compartments as shown in FIG. 24. The bench may have adjustable seat heights, seat back, storage compartments, shape sorters, fixed, hinged, or removable seat panels, removable wheels or casters, rocker means, recessed pull handle or lanyard, and stackable design. The bench may be utilized as a seat, step, storage unit, playcenter, steerable wagon or ride-on, or rocker, and may be sold knocked-down to be assembled and subsequently reconfigured by adults or children. As a step stool the bench may be used by adults. The invention may be regarded as a multi-functioned companion piece to serve and challenge mental and physical development. Discretionary fasteners allow age selective use so that a parent may introduce features and configurations at the appropriate development stage. Components and fastener locations may be standardized to encourage creativity and allow more extensive manipulation and configurations beyond the basic play units. Conceptually, the invention may be considered a large scale construction kit or transformer toy, suitable for ages 1 to 12 and adult.

There has been described novel apparatus and techniques for supporting characterized by safety, ease of use by adults and children and pleasing appearance. It is evident that those skilled in the art may now make numerous other uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A support structure comprising, a normally horizontal top panel having a pair of opposed long edges extending along its length and a pair of opposed narrow edges extending along its width, end panels secured to respective ones of said narrow edges and separated by said top panel long edges normally forming a small angle with the vertical, said end panels being formed with leg portions extending outside the horizontal projection of said top panel so that the separation between one of said leg portions and the other of said leg portions is greater than the top panel length and the distance spanned by each leg portion is greater than the top panel width.

2. A support structure in accordance with claim 1 and further comprising, normally vertical support members near the long edges of said top panel in contact with the underside of said top panel and formed with angled ends which angled ends abut said end panels.

3. A support structure in accordance with claim 2 and further comprising, tension means, said tension means being fastened to said end panels for urging said end panels together, said tension means being included by said normally vertical support members.

4. A support structure in accordance with claim 3 wherein said tension member comprise rods seated in a groove in a respective one of said vertical support members having one end secured to one end panel and the other end secured to the other end panel.

5. A support structure in accordance with claim 1 wherein each of said end panels is formed with a handle opening near the top above said top panel.

6. A support structure comprising, a normally horizontal top panel having a pair of opposed long edges extending along its length and a pair of opposed narrow edges extending along its width, end panels secured to respective ones of said narrow edges and separated by said top panel long edges normally forming a small angle with the vertical, said end panels being formed with leg portions extending outside the horizontal projection of said top panel so that the separation between one of said leg portions and the other of said leg portions is greater than the top panel length, wherein each of said leg members is formed with an outwardly extending portion of height slightly less than the height of a typical room baseboard for allowing the outwardly extending portion to enter the kick space beneath the lower edge of a cabinet when the leg portions rest on a floor adjacent to the cabinet.

7. A support structure in accordance with claim 1 wherein the height of said top panel above the plane including the bottom edges of said end panels is substantially 10", the width of said top panel is substantially 10" and the separation between lower inside edges of said end panels is substantially 20".

8. A support structure in accordance with claim 2 and further comprising means including said end panels, said top panel, a bottom panel below said top panel and said vertical support members defining a compartment below said top panel.

9. A support structure in accordance with claim 8 wherein at least one of said vertical support members is formed with an opening for providing access to said compartment.

10. A support structure in accordance with claim 8 wherein at least one of said end panels is formed with an opening below said top panel for providing access to said compartment.

11. A support structure in accordance with claim 10 and further comprising, at least one vertical divider adjacent to an access opening in said end panel for dividing said compartment into an end subcompartment.

12. A support structure in accordance with claim 11 wherein there are two of said vertical dividers adjacent to an access opening in each end panel for dividing said compartments into two end subcompartments separated by an intermediate compartments between the end subcompartments.

13. A support structure in accordance with claim 10 wherein said top panel is formed with openings above said end subcompartment.

14. A support structure in accordance with claim 12 wherein said top panel is formed with openings above each of said end subcompartments.

15. A support structure in accordance with claim 1 and further comprising, means for detachably securing said end panels and said top panel together.

16. A support structure in accordance with claim 15 wherein said means for detachably securing comprises, an internally threaded sleeve seated in one of said panels, and a threaded shaft with a knob for passing through an opening in another of said panels and threadingly engaging said internally threaded sleeve for fastening the latter panel member to the panel carrying the internally threaded sleeve.

17. A support structure in accordance with claim 16 and further comprising means associated with said hollow sleeve at the open end thereof extending perpendicularly outward from the sleeve axis and formed with sharp edges extending generally parallel to the sleeve axis for engaging the panel in which the sleeve is seated to reduce stress in the panel in which the sleeve is seated.

18. A support structure in accordance with claim 1 wherein each of said end panels has a top edge formed with a pair of notches separated by substantially the same distance as the separation between said vertical support members and of width corresponding substantially to the thickness of said vertical support members, whereby one of said support structures may support another with the normally vertical support members of said another resting in the notches of said one with the leg portions of said another outside the upper portion of the end panels of said another.

19. A support structure comprising, a normally horizontal top panel having a pair of opposed long edges extending along its length and a pair of opposed narrow edges extending along its width, end panels secured to respective ones of said narrow edges and separated by said top panel long edges normally forming a small angle with the vertical, said end panels being formed with leg portions extending outside the horizontal projection of said top panel so that the separation between one of said leg portions and the other of said leg portions is greater than the top panel length, first and second studs secured to each of said end panels at substantially the same height above said leg portions and of stud width, the bottoms of said leg portions being formed with notches of width corresponding substantially to said stud width, whereby one of said support structures may be supported by another with the notches in said one engaging the studs of said another.

20. A support structure in accordance with claim 1 and further comprising reversible rocker panels between said end panels near the bottom thereof detachably secured to said support structure for allowing rocking over different arcs.

21. A support structure comprising, a normally horizontal top panel having a pair of opposed long edges extending along its length and a pair of opposed narrow edges extending along its width, end panels secured to respective ones of said narrow edges and separated by said top panel long edges normally forming a small angle with the vertical, said end panels being formed with leg portions extending outside the horizontal projection of said top panel so that the separation between one of said leg portions and the other of said leg portions is greater than the top panel length, means including said end panels, said top panel, a bottom panel below said top panel and said vertical support members defining a compartment below said top panel, wherein said top panel is split along its length in the middle and hinged along each side of form doors covering the storage compartment space below.

22. A support structure comprising, a normally horizontal top panel having a pair of opposed long edges extending along its length and a pair of opposed narrow edges extending along its width, end panels secured to respective ones of said narrow edges and separated by said top panel long edges normally forming a small angle with the vertical, said end panels being formed with leg portions extending outside the horizontal projection of said top panel so that the separation between one of said leg portions and the other of said leg portions is greater than the top panel length, wherein each of said end panels comprises an upper end panel and a lower end panel with one of said upper and lower end panels being formed with internally threaded pairs of studs and the other of said upper and lower end panels being formed with pairs of openings for receiving respective internally threaded pairs of said studs, whereby the height of said support structure may be selectively adjusted by positioning selected pairs of internally threaded studs in selected pairs of openings.

23. A support structure in accordance with claim 6 wherein each of said end panels is formed with a handle opening near the top above said top panel.

24. A support structure in accordance with claim 1 wherein each of said end panels is formed with a groove for snugly accommodating opposed ends of said normally horizontal top panel, said opposed ends being seated in respective ones of said grooves.

* * * * *